343-909 SR
5/25/76 OR 3,959,796

United States Patent [19]
Merkel et al.

[11] 3,959,796
[45] May 25, 1976

[54] SIMULATION OF LORENTZ PLASMA BY RANDOM DISTRIBUTION OF INDUCTIVELY-LOADED DIPOLES

[75] Inventors: George Merkel, Springfield; John F. W. Dietz, Alexandria, both of Va.

[73] Assignee: The United States of America as represented by the Secretary of the Army, Washington, D.C.

[22] Filed: Dec. 5, 1974

[21] Appl. No.: 529,878

[52] U.S. Cl. ..... 343/909
[51] Int. Cl.[2] ..... H01Q 15/10
[58] Field of Search ..... 343/753, 909, 911 R

[56] References Cited
UNITED STATES PATENTS 2,841,786 7/1958 Dicke ..... 343/909
3,430,248 2/1969 Lightbowne ..... 343/911

*Primary Examiner*—Eli Lieberman
*Attorney, Agent, or Firm*—Nathan Edelberg; Robert P. Gibson; Saul Elbaum

[57] ABSTRACT

An artificial dielectric comprising a random distribution of inductively-loaded short dipoles for simulating the macroscopic electromagnetic properties of a simple Lorentz plasma. The inductively-loaded dipoles are preferably mounted within styrofoam spheres which, when randomly distributed, comprise a granular pellet-like artificial dielectric. A theoretical discussion is presented and compared with experimental results.

5 Claims, 5 Drawing Figures

FIG. 1.
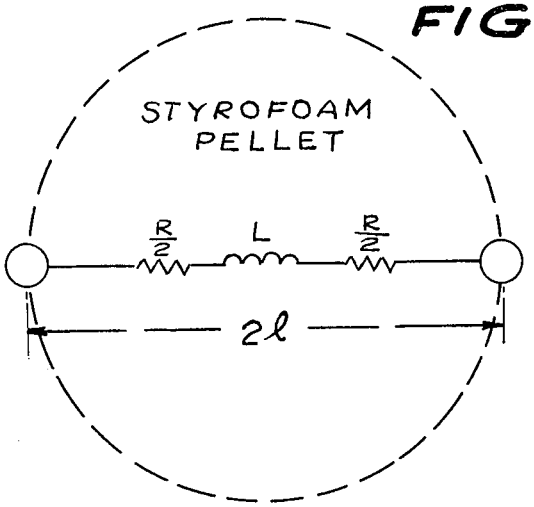
FIG. 3.
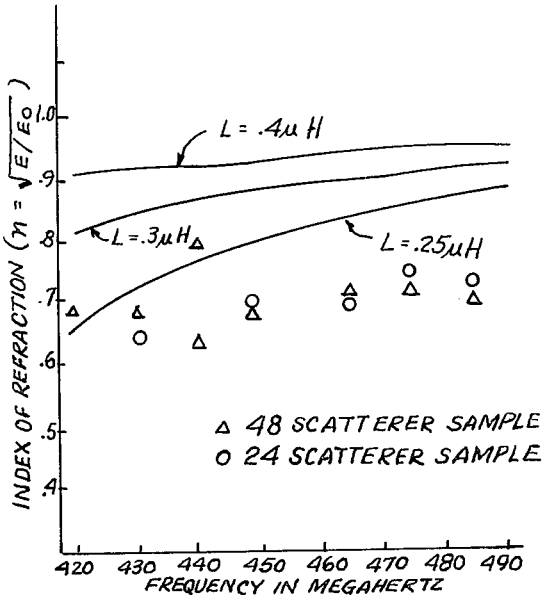
FIG. 2A.
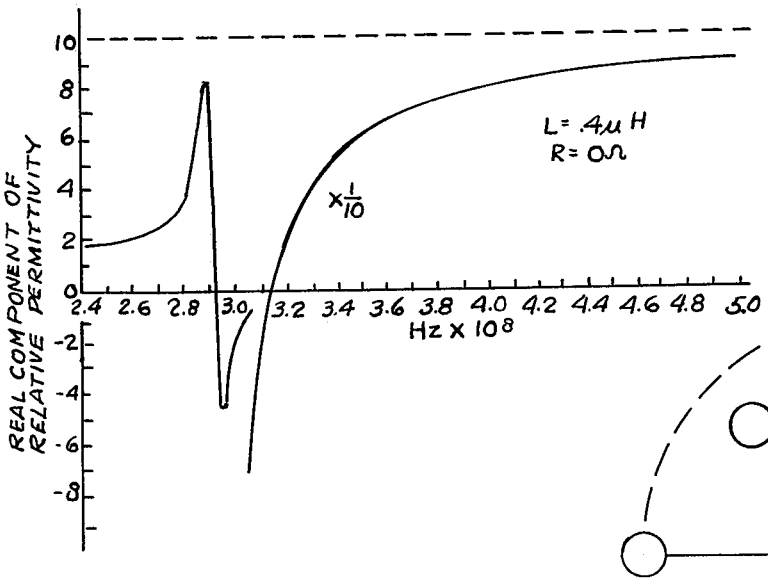
FIG. 2B.
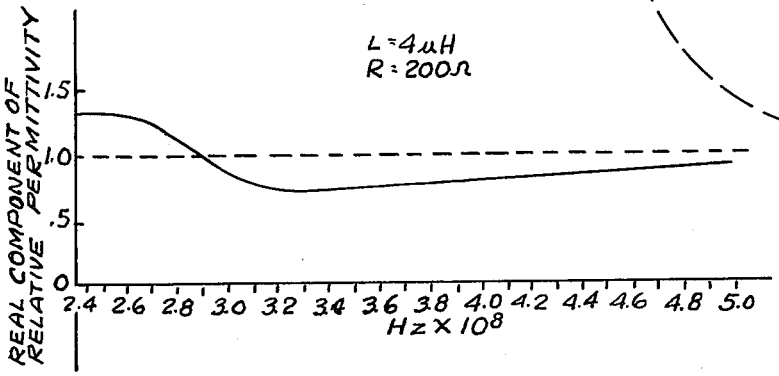
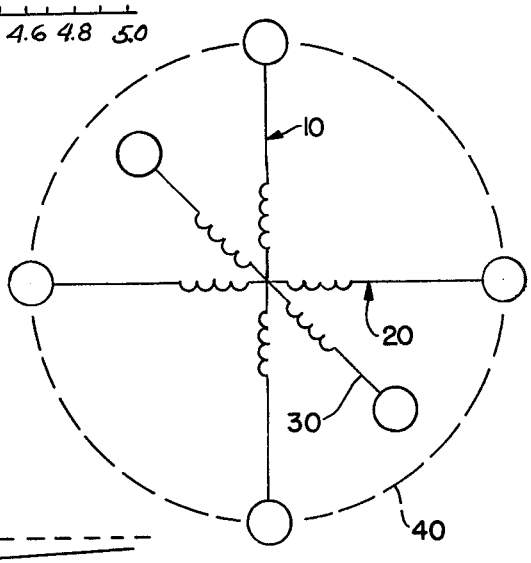
FIG. 4

SIMULATION OF LORENTZ PLASMA BY RANDOM DISTRIBUTION OF INDUCTIVELY-LOADED DIPOLES

RIGHTS OF THE GOVERNMENT

The invention described herein may be manufactured, used, and licensed by or for the United States Government for governmental purposes without the payment to us of any royalty thereon.

DESCRIPTION OF THE PRIOR ART

The complete simulation of the electromagnetic pulse (EMP) associated with a nuclear burst involves a number of interrelated parameters. The most obvious parameters are the waveform and the magnitude of the EMP. However, if the system being subjected to the nuclear EMP such as a missile or satellite is in a preionized region such as the ionosphere, the ionization or dielectric constant of the medium surrounding the system would also have to be simulated.

During the past 25 years a number of so-called artifical dielectrics consisting of regularly spaced rods, parallel plates, metal spheres, etc. have been devised to reproduce the essential macroscopic properties of a dielectric. The ordinary artificial dielectric consists of discrete metallic or dielectric particles or lattices of macroscopic size. These artificial dielectrics were first actually conceived as large-scale macroscopic models of microscopic crystal lattices. The practical motivation for the development of the first artificial dielectrics was the desire to obtain relatively inexpensive lightweight materials that could be used for microwave and radar lenses. Several of the artificial dielectrics proposed for microwave lenses have the macroscopic electromagnetic properties of a plasma.

Prior art plasma simulation techniques of artificial dielectrics include the utilization of a rigid cubic lattice of three-dimensional grids. Experimental work, reported in the literature, has been done only on two-dimensional grid lattice structures. It has been theorized that a periodic grid structure produces band structure resonances analogous to Bragg scattering, but, to the best of our knowledge, such has not yet been experimentally investigated.

Such a rigid cubic grid lattice structure has the disadvantages of being somewhat unwieldy and difficult to support and fit around an object with curved surfaces making the application and use thereof somewhat limited.

SUMMARY OF THE INVENTION

It is therefore a primary object of the present invention to provide a method and apparatus for simulating a Lorentzian plasma which overcomes the disadvantages of prior art techniques discussed above.

Another object of the present invention is to provide an artificial dielectric utilized to simulate the macroscopic electromagnetic properties of a simple Lorentz plasma which is physically easier to handle, support, and fit around an object with curved surfaces.

We have discovered that a granular pellet-like artificial dielectric consisting of a random distribution of styrofoam spheres containing inductively-loaded dipoles yields macroscopic electromagnetic constitutive relationships similar to those of a simple Lorentzian plasma.

A Lorentz plasma can be represented, from the viewpoint of macroscopic electromagnetic theory, as a lossy dielectric with a complex dielectric constant given by $$\epsilon_p = \epsilon_o \{1 - \omega_p^2/(\nu^2 + \omega^2) + j\omega_p^2(\nu/\omega)/(\nu^2 + \omega^2)\}. \quad (1)$$

where $\epsilon_0$ is the dielectric constant of free space, $\omega$ is the angular frequency of the electromagnetic field, $\omega_p$ is the plasma frequency, and $\nu$ is the collision frequency between electrons and the gas molecules. In accordance with this invention, this macroscopic dielectric constant may be simulated with an artificial dielectric consisting of a random distribution of inductively-loaded dipoles encased in styrofoam pellets. A schematic drawing of such a dipole is shown in FIG. 1. The quantities $2l$, L, and R represent the length, inductance, and resistance of the loaded dipole, respectively. As will be shown hereinafter, using simple quasi-static arguments, if the load impedance is much greater than the capacitive impedance of the dipole, the permittivity of a random distribution of inductively-loaded dipoles is $$\epsilon_p = \epsilon_0 \left\{ 1 - \frac{\frac{4}{3}\frac{l^2}{\epsilon_0}\frac{N}{L}}{\left(\frac{R}{L}\right)^2 + \omega^2} + j\frac{\frac{4}{3}\frac{l^2}{\epsilon_0}\frac{N}{L}\left(\frac{R}{L}\right)\frac{1}{\omega}}{\left(\frac{R}{L}\right)^2 + \omega^2} \right\}. \quad (2)$$

where N is the number density of the dipole pellets. By comparing equation (1) with equation (2), it can be observed that a plasma may be simulated with a plasma frequency $\omega_p$ and collision frequency $\nu$ by setting $$\frac{4}{3}\frac{l^2}{\epsilon_0}\frac{N}{L} = \omega_p^2 \quad (3)$$

and $$\frac{R}{L} = \nu. \quad (4)$$

BRIEF DESCRIPTION OF THE DRAWINGS

FIG. 1 is a schematic representation of a styrofoam encased inductively loaded dipole which comprises one of the artificial dielectric components according to a preferred embodiment of the present invention;

FIGS. 2*a*, 2*b* and 3 are graphs which illustrate experimental results of measurements made in accordance with the present invention; and FIG. 4 is a schematic illustration of three mutually perpendicular inductively-loaded dipoles encased in a styrofoam pellet in accordance with another embodiment of the present invention.

DETAILED DESCRIPTION OF THE INVENTION

The following theoretical and experimental discussion of the preferred embodiment of the present invention comprises an abbreviated version of a more detailed description thereof which may be found in HDL-TR-1637, "Simulation of A Simple Lorentz Plasma With A Random Distribution of Inductively-Loaded Dipoles" by G. Merkel, U.S. Army Material Command, Harry Diamond Laboratories, November, 1973, which is hereby expressly incorporated herein by reference. The following disclosure, while condensed from the more detailed report just cited, is nevertheless fully adequate to enable a person or ordinary skill in the art to make and use the present invention.

I. THEORETICAL DISCUSSION a. Quasi-Static Approach

From a quasi-static viewpoint, it may be assumed that the inductive load of the dipole is much larger than the driving point capacitive impedance of a short dipole.

An artificial dielectric is desired to be constructed from a pellet-like medium that has an index of refraction given by $$n = \left(\frac{\epsilon_p}{\epsilon_0}\right)^{1/2} \tag{5}$$

and an intrinsic impedance given by $$\eta = \left(\frac{\mu_0}{\epsilon_p}\right)^{1/2} \tag{6}$$

where $\epsilon_p$ is given by equation (1).

In general, the index of refraction of an artificial dielectric may be calculated in a manner analogous to that employed in calculating the index of refraction of a molecular medium. Assuming that the random obstacles are not too closely packed so that we do not have to resort to the Clausius-Mossotti relation, the index of refraction is given by $$n = [\epsilon_1 (1 + N\chi_e/\epsilon_o)\, \mu_1 (1 + N\chi_m/\mu_o)]^{1/2} \tag{7}$$

where $N$ = Number of scattering obstacles per unit volume,
$\chi_e$ = Electric polarizability of a scattering obstacle,
$\chi_m$ = Magnetic polarizability of a scattering obstacle,
$\epsilon_1 = 1$ (for styrofoam),
$\mu_1 = 1$ (for styrofoam),
$\epsilon_o$ = permittivity of free space,
$\mu_o$ = permeability of free space.

In accordance with this invention, the scattering obstacle comprises an inductively-loaded electric dipole. Referring now to the very idealized inductively-loaded dipole schematically shown in FIG. 1, let an electric field E be applied parallel to the line between two spheres separated by the distance $2l$. The field E then establishes a voltage $V=2lEe^{j\omega t}$ between the spheres. Assume that the inductance between the two spheres is L, and also assume that $L\omega >> 1/\omega C$, where C is the capacitance between the two spheres. Since the field E is a time harmonic field, assume that the charge accumulated on the dipole spheres is given by $$q = Qe^{j\omega t}. \tag{8}$$

Then $$2lE\, e^{j\omega t} = LQ(-\omega^2)e^{j\omega t} + RQj\omega\, e^{j\omega t},$$

so that $$q = -2lE\, e^{j\omega t}/(L\omega^2 - jR\omega). \tag{9}$$

The dipole moment along the axis of the inductive dipole in FIG. 1 is then $$p = 2lq = -4l^2E\, e^{j\omega t}/(L\omega^2 - jR\omega). \tag{10}$$

To calculate the average polarization in the direction of the incident electric field when the field is not parallel to the dipole, multiply equation (10) by $\cos^2\theta$ and integrate over all possible values of $\theta$.

Then $p_{av} = \frac{1}{3}p$. Since $p_{av} = \chi_{eav}Ee^{j\omega t}$ the polarizability, $\chi_{eav}$, is given by ), $$\chi_{eav} = -4l^2/3(L\omega^2 - jR\omega), \tag{11}$$

and, if $$\chi_m \simeq 0,$$
$$\epsilon_p = \epsilon_0[1 - 4l^2N/3\epsilon_0 L\omega^2(1 - jR/\omega L)] \tag{12}$$

$$= \epsilon_0\left\{1 - \frac{\frac{4}{3}\,\frac{l^2N}{\epsilon_0 L}}{\left(\frac{R}{L}\right)^2 + \omega^2} + j\,\frac{\frac{4}{3}\,\frac{l^2N}{\epsilon L}\left(\frac{R}{L}\right)\frac{1}{\omega}}{\left(\frac{R}{L}\right)^2 + \omega^2}\right\}. \tag{13}$$

Note that if equations (3) and (4) are satisfied, we have a one-to-one correspondence between equations (1) and (13).

b. Consideration of Dipole Capacitance

Hereinabove, it as been assumed that the inductance used to load the short dipole dominated the behavior of the dipole. Using the results of King (R.W.P. King, The Theory of Linear Antennas, Harvard University Press, Cambridge, Massachusetts, 1956, page 184) and of Harrington (R. F. Harrington, "Small Resonant Scatterers and Their Use for Field Measurements," IRE Transactions of Microwave Theory and Techniques, May, 1962, pages 165–174), it can be shown that the electric dipole moment of a short inductively-loaded dipole that is aligned parallel to an incident electric field E is given by $$p = \frac{-j\,B^2\,E\,e^{j\omega t}}{4\omega(j\omega L + R + Z_{22}} \tag{14}$$

where B is the dipole length, $(j\,\omega\,L + R)$ is the impedance of the centrally located load and $Z_{22}$ is the short dipole impedance. King gives the value of $Z_{22}$ $$Z_{22} = \frac{\eta}{2\pi}\left[\frac{\left(\frac{\omega}{c}\right)^2 B^2}{12} - j\,\frac{4\ln\left(\frac{B}{A}\right) - 6.78}{\left(\frac{\omega}{c}\right)B}\right] \tag{15}$$

where $\eta$ is the impedance of free space, $120\pi\Omega$, and A is the dipole radius. As before $$p_{av} = \tfrac{1}{3}p,$$

so that $$X_{av} = \frac{-j\,B^2}{12\omega(j\omega L + R + Z_{22})} \tag{16}$$

If we set $Z_{22}=0$, $B=2l$, and end load the dipole so that the current distribution is uniform and not triangular, the same result is obtained as that given by equation (11).

The appearance of $Z_{22}$ in the denominator of expression (14) is inconsistent with the desire to model a simple Lorentzian plasma. Specifically, when the frequency is such that the inductive reactance of the load equals the capacitive reactance of the dipole, the artificial dielectric will pass through a resonance. The inductively-loaded dipoles may be utilized to simulate a plasma only if $\omega L >> Z_{22}$. We will discuss the effect of $Z_{22}$ is more detail hereinbelow.

c. Mutually Perpendicular Dipole Scatterers

It has been thus far assumed that the distance between the inductively-loaded dipoles is large enough such that their interaction can be neglected. The use of equation (7) is based on the assumption of negligible interaction between scattering objects. A way of increasing the value of N in equation (7) by a factor of 3 without violating the assumption of negligible interaction of neighboring scatterers is to construct each scatterer out of three mutually perpendicular, inductively-loaded dipoles 10, 20 and 30 illustrated in FIG. 4 as encased within a styrofoam pellet 40. If three mutually perpendicular dipoles are substituted for the single randomly distributed dipoles, the average value of the polarizability given in equation (16) is simply multiplied by 3.

By constructing the scatterers out of three mutually perpendicular, inductively-loaded dipoles, in addition to simply increasing the number of scatterers by three, the polarizability of the scattering centers is made to be independent of scatterer orientation. To be specific, the scatterer, consisting of three identical, short, mutually perpendicular dipoles centered at the origin with a dipole along each axis, can be described with the following simple dyadic:

$$\chi = \underline{\underline{\chi}}\,(\hat{i}\,\hat{i}+\hat{j}\,\hat{j}+\hat{k}\,\hat{k}) = \chi \underline{\underline{I}}$$

The dipole moment induced by an arbitrary field $\vec{E}$ is then $$\begin{aligned}\vec{p} &= \underline{\underline{\chi}}\cdot\vec{E}\,E \\ &= \underline{\underline{\chi}}\cdot E(\hat{i}\sin\theta\cos\Phi+\hat{j}\sin\theta\sin\Phi+\hat{k}\cos\theta) \qquad (17)\\ &= \chi\,E\,(\hat{i}\sin\theta\cos\Phi+\hat{j}\sin\theta\sin\Phi+\hat{k}\cos\theta),\end{aligned}$$

but $(\sin\theta\cos\Phi)^2+(\sin\theta\sin\Phi)^2+\cos^2\theta=1$. Therefore, the magnitude of the dipole moment is $\chi E$, and its direction is in the direction of the electric field regardless of the orientation of the scatterer.

d. Coupling of Scatterers

Hereinabove, the scattering dipoles have been considered as having a spatial distribution such that their mutual interactions can be neglected, i.e., it has been assumed that the local field at a dipole scatterer is given by the applied field. As a first approximation to the effect of the other scatters upon the local field of a scatterer, the expression for the polarizability, $\chi_{av3} = 3\chi_{av}$, may be combined with the well-known Clausius-Mossotti equation.

The permittivity of the artificial dielectric is then given by $$\epsilon = \epsilon_0 \left[\frac{1+2\,N\,X_{av3}/3\epsilon_0}{1-N\,X_{av3}/3\epsilon_0}\right]. \qquad (18)$$

When the number density of scatterers N is small, and $\chi_m \simeq 0$, equations (7) and (18) are equivalent. Strictly speaking, equation (18) is based upon the assumption of a cubic lattice spatial distribution, and the applicability of equation (18) to an accumulation of dipole scatterers that have been dumped into a container will now be justified.

e. Deviations from the Clausius-Mossotti Equation Due to Randomness of Scatterers J. G. Kirkwood (J. G. Kirkwood, "On the Theory of Dielectric Polarization," J. Chem. Phys., Vol. 6, page 592, September, 1936) has calculated the deviations that one might expect from the Clausius-Mossotti equation in the case of a random distribution of molecules consisting of hard spheres. Specifically, Kirkwood considered a molecular interaction potential of the form $$\begin{aligned}W(r) &= \infty \qquad 0 \le r \le a \\ &= 0 \qquad r > a\end{aligned} \qquad (19)$$

where $a$ is the diameter of a molecule.

Kirkwood's model is not wholly applicable to an artificial dielectric formed by dumping spherical scatterers into a container because the scatterers do not necessarily assume a completely random distribution.

It is interesting to note that statistical mechanical averaging based on the molecular interaction equation (19) yields a value of the permittivity that is not a function of the thermodynamic temperature T. This follows because the value of the exponential term $\exp[-W(r)/kT]$ is either 0 or 1. In a gas or fluid the averaging can be over time; in the static collection of scattering dipoles, the averaging would have to be over an ensemble of different containers, each filled with an aggregation of spherical dipole scatterers. Kirkwood's approach can be summarized as follows: As in the lattice case, the local field is obtained by summing over the potentials due to individual dipoles. The effective polarizing field $E_{loci}$ at scatterer $i$ will be given by $E + E_i$, where E is the external applied field and $E_i$ is given by the sum over N individual dipoles:

$$\vec{E}_i = -\sum_{\substack{K=1\\ \neq i}}^{N} \underline{\underline{T}}_{ik}\cdot\vec{p}_k \qquad (20)$$

where the dipole-interaction dyadic is given by:

$$\underline{\underline{T}}_{ik} = \frac{1}{4\pi\epsilon_0}\,\frac{1}{r_{ik}^3}\left[\underline{\underline{I}} - 3\,\frac{\vec{r}_{ik}\,\vec{r}_{ik}}{r_{ik}^2}\right] \qquad (21)$$

The polarization of an individual scatterer is given by $$p_i = \epsilon_0\underline{\underline{\alpha}}\cdot\vec{E}_{loci} = \epsilon_0\underline{\underline{\alpha}}\cdot(\vec{E}+\vec{E}_i).$$

There are therefore N simultaneous equations $$\vec{p}_i + \alpha\epsilon_0\,\Sigma\underline{\underline{T}}_{ik}\cdot\vec{p}_k = \alpha\epsilon_0\vec{E}\quad i = 1,\ldots N$$

that would have to be solved in order to obtain $E_{loci}$ for each of the individual scatterers in the distribution of N scatterers in volume V. The N equations may be averaged to obtain.

$$\vec{p} + \alpha\epsilon_o \Sigma \overline{\underline{\underline{T}}_{ik} \cdot \vec{p}_k} = \alpha\epsilon_o \vec{E} \tag{22}$$

Kirkwood introduced the following fluctuation term $$\vec{n} = \sum_{\substack{i=1 \\ i \neq k}}^{N} (\overline{\underline{\underline{T}}_{ik} \cdot \vec{p}_k} - \overline{\underline{\underline{T}}_{ik}} \cdot \overline{\vec{p}_k}) \tag{23}$$

and obtained $$\vec{p} + \alpha\epsilon_o \Sigma \overline{\underline{\underline{T}}_{ik}} \cdot \vec{p} + \vec{n}\alpha\epsilon_o = \alpha\epsilon_o \vec{E} \tag{24}$$

Assuming that $$\overline{\underline{\underline{T}}_{12} \cdot \vec{p}_1} = \overline{\underline{\underline{T}}_{12}} \cdot \vec{p}_1, \tag{25}$$

the fluctuation $\vec{n}$ is equal to zero, and the permittivity $\epsilon$ is given by $$\epsilon = \epsilon_0 \left\{ \frac{1 + \frac{2}{3} \frac{N}{v} \frac{X_{av3}}{\epsilon_0}}{1 - \frac{1}{3} \frac{N}{v} \frac{X_{av3}}{\epsilon_0}} \right\}. \tag{26}$$

Equation (26) is to be compared with equation (18). After considerable mathematical manipulation and a number of approximations, Kirkwood managed to evaluate equation (23) for a substance consisting of a random distribution of hard, noninteracting spheres of diameter *a:*

$$n = \left(\frac{1}{9b} - \frac{5}{48v}\right) \frac{N^2\alpha^2 D}{v} (\alpha = X_{av3}/\epsilon_0), \tag{27}$$

where $$b = \frac{2\pi N a^3}{3} = 4\,N \left(\frac{\pi a^3}{6}\right) = 4 \text{ (volume of spherical scatterers).}$$

To obtain a rough estimate of the validity of using the Clausius-Mossotti equation for a random distribution of styrofoam ball dipole scatterers, compare the value of $n$ given by equation (27) with the value of the first two terms of the expansion of equation (24)

$$1 - \alpha \Sigma \overline{T_{ik}} = 1 - \frac{1}{3} \frac{N\alpha}{v}$$

For the experimental situation to be discussed hereinbelow:

$$\frac{n}{1 - \alpha \Sigma \overline{T_{ik}}} = .22,$$

and the Clausius-Mossotti equation would appear to be a reasonable first approximation. Actually, as pointed out above, Kirkwood's statistical model is not necessarily applicable to the aggregation of dipole scatterers because the dipole scatterers in the artificial dielectric do not necessarily assume a random distribution. The validity of the Clausius-Mossotti equation as applied to the artificial dielectric was therefore tested empirically.

II. COMPARISON OF EXPERIMENT WITH THEORY

Equation (18) and the expression for $\chi_{av3}$ obtained in section I.d. were utilized to design an artificial dielectric. The frequency range considered was dictated by the band pass characteristics of the type 2300 waveguide. The type 2300 waveguide, the largest standard waveguide, has internal dimensions of 23.0 × 11.5 in., a lower cutoff frequency of $2.56 \times 10^8$ HZ, and a recommended upper frequency limit of $4.9 \times 10^8$ HZ. The frequencies in this range are much higher than the values usually quoted for nuclear EMP pulses, but an artificial dielectric was designed to operate at these high frequencies because of the convenience of using waveguide techniques in measuring the properties of an artificial dielectric.

The artificial dielectric was constructed out of scatterers consisting of three mutually perpendicular, 7-inch long dipoles loaded with an inductance of 0.4 $\mu$H. The stems had a radius of 0.1 cm. The density of scatterers was chosen to be 264 per cubic meter. This density corresponds to an aggregation of 48 scatterers throughout a rectangular container with dimensions 23 × 11.5 × 41.5 inches.

FIGS. 2a 2b illustrate values of the real part of the permittivity calculated with equation (18) with L = 0.4 $\mu$H. FIG. 2a, corresponding to a purely inductive load, emphasizes the resonance behavior of the artificial dielectric produced when the load inductance L is in resonance with the capacitive impedance of the dipole. As expected, the Q of the resonance may be reduced by including a resistance in the dipole load impedance.

In a first experiment, the resonance predicted by equation (16) and shown in FIG. 2a was sought. The experimental setup consisted of a sample of 48 7-inch diameter styrofoam balls placed in a large type 2300 waveguide with a matched termination. A series of V.S.W.R. measurements yielded a large resonance in the reflection coefficient at approximately the resonance frequency shown in FIG. 2a.

In a second series of experiments, the permittivity of the artificial dielectric was measured utilizing the well-known shorted waveguide technique described in great detail by von Hippel (A. R. von Hippel, Editor, Dielectric Materials and Applications, The M.I.T. Press, Cambridge, Massachusetts, 1954, Sec. 2, page 63, W. Westphal). Briefly, his technique consists of measuring the null point of a standing wave in a shorted waveguide. A sample of length $l$ is then inserted into the shorted waveguide and the shift in the standing wave null is noted. The index of refraction of the dielectric sample of length $l$ can then be calculated in terms of $l$ and the shift in the standing wave null point.

FIG. 3 illustrates both experimental and calculated values of the index of refraction. The measurements were conducted on two different artificial dielectric sample sizes; one sample consisted of an aggregation of 24 scatterers measuring 23 × 11.5 × 20.75 inches in volume. The length of the sample was $l$ = 20.75 inches. The other sample consisted of an aggregation of 48 scatterers in a rectangular volume measuring 13 × 11.5 × 41.5 inches. In the latter case, $l = 41.5$ inches.

As may be observed from FIG. 3, the difference between the theoretical index of refraction curve corresponding to $L = 0.4\ \mu H$ and $R = 0$ and the measured index of refraction is about 30 percent. One possible source of the disparity between experiment and theory is that the dimension of the cardboard box that enclosed the scatterers was utilized to obtain $l$. The effective length of the very granular artificial dielectric sample is most probably not the size of the box containing the scatterers.

It is interesting that the more exact expressions for the dielectric constant of the artificial dielectric, which considered both the effect of the capacitive dipole impedance and the dipole-dipole interaction, did not model the behavior of a Lorentzian plasma as well as the original simplified approach. Nevertheless, the artificial dielectric constructed in accordance with the present invention, did have an index of refraction less than one over a relatively broad spectrum.

We wish it to be understood that we do not desire to be limited to the exact details of construction shown and described, for obvious modifications can be made by a person skilled in the art.

We claim as our invention:

1. Apparatus for simulating an artificial dielectric in a plasma space, which comprises means for simulating a Lorentz plasma in said plasma space which comprises a plurality of inductively-loaded dipole scatterers each of which is individually encased in a nonpermeable pellet, the plurality of pellets containing respectively said plurality of inductively-loaded dipole scatterers being randomly distributed and oriented throughout said plasma space.

2. The apparatus as set forth in claim 1 wherein the collision frequency $\nu$ between electrons and gas molecules of said simulated plasma and the plasma frequency $\omega p$ are defined by the following relationships:

$$\omega_p^2 = \frac{4}{3}\ \frac{l^2}{\epsilon_o}\ \frac{N}{L}, \text{ and}$$

$$\nu = \frac{R}{L}$$

wherein:

$2l$ = the length of each dipole

L = the inductance of each dipole

R = the resistance of each dipole

N = the density of said non-permeable pellet $\epsilon_o$ = the dielectric constant of free space

3. The apparatus as set forth in claim 1 wherein each of said dipole scatterers comprises three mutually perpendicular inductively-loaded dipoles.

4. The apparatus as set forth in claim 3 wherein each of said dipole scatterers is encased in a spherically shaped styrofoam pellet.

5. The apparatus as set forth in claim 1 wherein each of said dipole scatterers is encased in a spherically shaped styrofoam pellet.

* * * * *